US008701395B2

(12) United States Patent
Pignon

(10) Patent No.: US 8,701,395 B2
(45) Date of Patent: Apr. 22, 2014

(54) REFORMER

(75) Inventor: John Frederick Pignon, Benson (GB)

(73) Assignee: Johnson Matthey Public Limited Company, London (GB)

( * ) Notice: Subject to any disclaimer, the term of this patent is extended or adjusted under 35 U.S.C. 154(b) by 246 days.

(21) Appl. No.: 13/112,621

(22) Filed: May 20, 2011

(65) Prior Publication Data

US 2012/0117943 A1 May 17, 2012

(30) Foreign Application Priority Data

Nov. 11, 2010 (GB) ..... 1019024.7

(51) Int. Cl.
*F01N 3/10* (2006.01)

(52) U.S. Cl.
USPC ..... 60/303; 60/274; 60/286; 60/302; 48/197 R; 48/198.1; 48/198.3

(58) Field of Classification Search
USPC ..... 60/274, 286, 287, 297, 301, 303; 48/197 R, 198.1, 198.3
See application file for complete search history.

(56) References Cited

U.S. PATENT DOCUMENTS

| | | | | |
|---|---|---|---|---|
| 4,211,075 | A | 7/1980 | Ludecke et al. | |
| 7,334,400 | B2 * | 2/2008 | Yan et al. | 60/286 |
| 7,700,070 | B2 * | 4/2010 | Finkbeiner et al. | 423/650 |
| 8,037,674 | B2 * | 10/2011 | Kupe et al. | 60/286 |
| 8,069,654 | B2 * | 12/2011 | Ginter et al. | 60/286 |
| 8,209,960 | B2 * | 7/2012 | Shamis et al. | 60/286 |
| 8,353,151 | B2 * | 1/2013 | Tsujimoto et al. | 60/286 |
| 2004/0187483 | A1 | 9/2004 | Dalla Betta et al. | |
| 2010/0300382 | A1 | 12/2010 | Yahagi et al. | |
| 2011/0107749 | A1 | 5/2011 | Tsujimoto et al. | |

FOREIGN PATENT DOCUMENTS

| | | | |
|---|---|---|---|
| EP | 1640580 | A1 | 3/2006 |
| JP | 2009236016 | A1 | 10/2009 |
| JP | 2009257217 | A1 | 11/2009 |

OTHER PUBLICATIONS

GB Search Report dated Mar. 9, 2011 for corresponding Patent Application No. GB1019024.7 filed Nov. 11, 2010.

Ashur et al., "On board Exhaust Gas Reforming of Gasoline Using Combined Reformer & TWC," *SAE Technical Paper Series*, Paper No. SAE-07NAPLES-175, Copyright © 2007 SAE International.

* cited by examiner

*Primary Examiner* — Binh Q Tran
(74) *Attorney, Agent, or Firm* — Kevin M. Carroll

(57) ABSTRACT

An exhaust gas treating system for a gasoline engine, comprising an exhaust gas manifold comprising an annular reforming catalyst mounted within an annular housing and fuel supply means in direct fluid connection with the catalyst, an outlet for reformed fuel products in direct fluid connection with the catalyst, and means to permit a proportion of the engine-out exhaust gases to enter the annular catalyst to mix with fuel from the fuel supply means and to pass through the catalyst, the annular housing being located such that hot engine-out exhaust gases can flow around and through the center of the housing, such that heat is transferred from the exhaust gases to the catalyst within the housing. The reformate may be passed to the inlet side of the engine, to improve overall efficiency of the engine, and/or may be mixed with exhaust gas before catalytic aftertreatment, to improve the control of emissions.

10 Claims, 1 Drawing Sheet

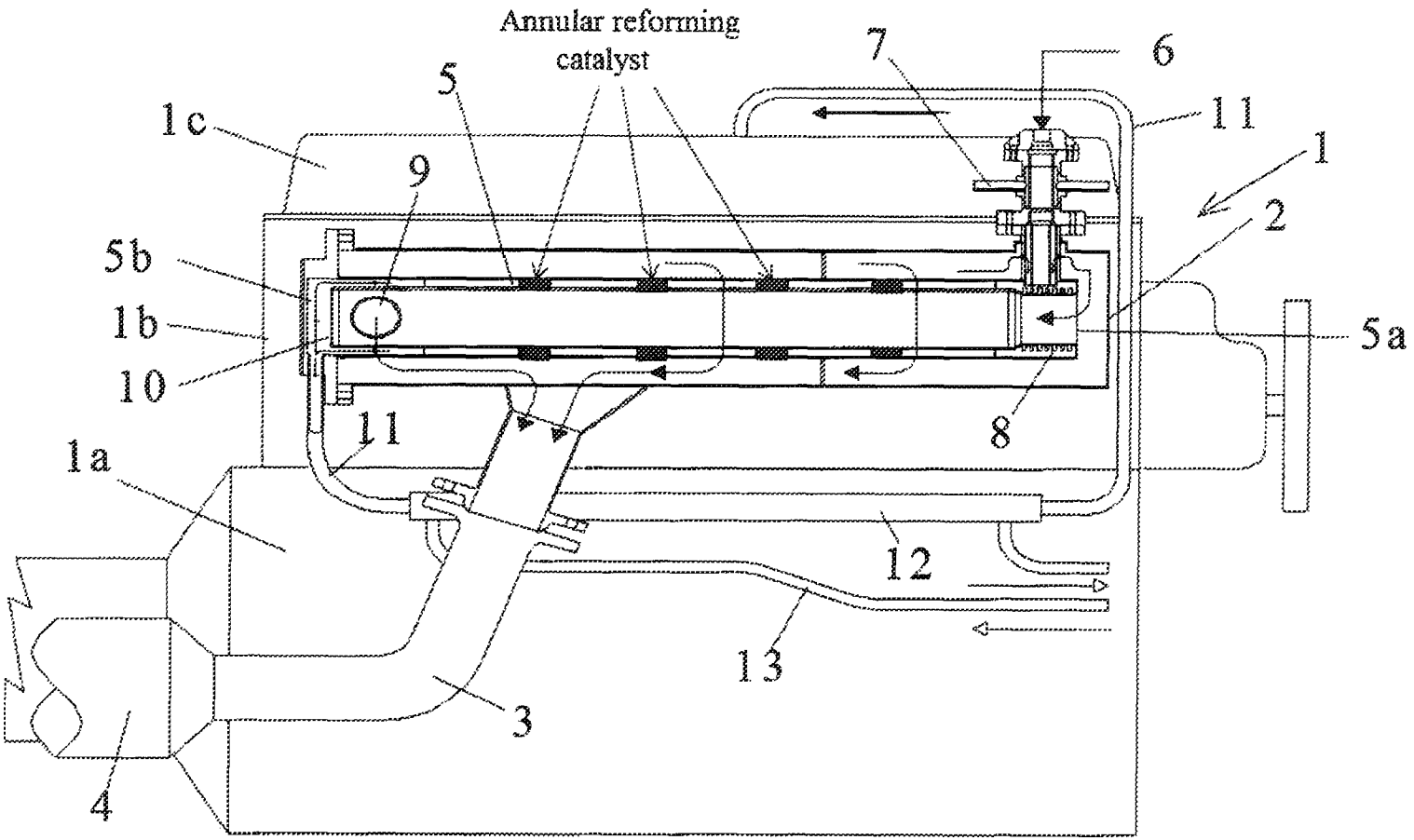
1
2
5a
11
6
7
8
12
13
Annular reforming catalyst
5
9
11
3
1c
5b
1b
10
1a
4

REFORMER

CROSS-REFERENCE TO RELATED APPLICATIONS

This application claims priority to British Patent Application No. 1019024.7, filed Nov. 11, 2010, the disclosure of which is incorporated herein by reference in its entirety for all purposes.

FIELD OF THE INVENTION

The present invention concerns an improved reformer design, and more especially concerns an improved reformer for the exhaust from gasoline-fuelled (spark ignition) internal combustion engines.

BACKGROUND OF THE INVENTION

The reforming of hydrocarbons to form synthesis gas ($H_2$ and CO) is a well established industrial process. Such processes operate essentially at steady state, and under controlled conditions. On board fuel reformers have been proposed for fuel cell-powered vehicles, but have not yet been commercialised. Fuel cell catalysts are poisoned by even small amounts of CO, and this therefore necessitates considerable further treatment of the reformate to remove CO.

It has been proposed to reform exhaust gas components from gasoline engines, for example in SAE-07NAPLES-175. There is some current interest in reforming because of the potential for recovery of energy in the form of combustion heat in the exhaust by conversion of exhaust components into fuel components of higher calorific value ($H_2$ and CO). This could permit an increase in overall efficiency of a gasoline engine and an associated decrease in fuel consumption and a decrease in $CO_2$ emissions. Further, it is believed that improvements in levels of regulated pollutants can be achieved by including hydrogen in the fuel of a gasoline engine.

The use of exhaust gas recirculation (EGR) is now commonplace on road vehicles, primarily because of the reduction of the $NO_x$ pollutants. However, there is also the potential for some efficiency gains.

SUMMARY OF THE INVENTION

Most, if not all, of the reforming proposals to date have been theoretical or academic studies, and could not readily be converted into a practical device for fitting onto a road vehicle. The large variations in gas volumes and temperatures in a vehicle exhaust make reforming challenging. It is an aim of the present invention to provide such a practical reformer.

The engine-out exhaust gases from gasoline engines are at temperatures of the order of 600-800° C., and are capable of raising the temperature of a reformer to that required for the endothermic steam reforming reaction. The exhaust gases from a stoichiometric gasoline engine are primarily nitrogen from inlet air, $CO_2$ and water vapour, with minor amounts of the regulated pollutants CO, unburnt hydrocarbons (HC) and $NO_x$. There is sufficient water vapour to permit steam reforming at the levels suitable for exhaust gas reforming without the addition of supplementary water, but the quantity of unburnt HC is much too low to achieve useful reforming. The exhaust gases from a normal stoichiometric gasoline engine are significantly depleted in oxygen, so that oxidative or partial oxidative reforming cannot be achieved without the addition of air. Accordingly, it is necessary to add fuel, conveniently in the form of gasoline from the fuel line to the engine. This is much preferable to the supply of other fuels to a reformer such as oxygenated fuels (methanol, ethanol, MTBE) which would require additional storage and supply arrangements both on-board the vehicle and in the fuel delivery infrastructure.

The present invention is not presently intended for turbocharged (or supercharged) gasoline engines.

Accordingly, the present invention provides an exhaust gas treating system for a gasoline engine, comprising an exhaust gas manifold comprising an annular reforming catalyst mounted within an annular housing and fuel supply means in direct fluid connection with the catalyst, an outlet for reformed fuel products in direct fluid connection with the catalyst, and means to permit a proportion of the engine-out exhaust gases to enter the annular catalyst to mix with fuel from the fuel supply means and to pass through the catalyst, the annular housing being located such that hot engine-out exhaust gases can flow around and through the centre of the housing, such that heat is transferred from the exhaust gases to the catalyst within the housing.

The invention also provides a method of increasing the efficiency of a gasoline engine, comprising operation of the exhaust gas treating system according to the invention.

BRIEF DESCRIPTION OF THE FIGURES

The invention will now be described with reference to the accompanying drawings, in which:

FIG. 1 is a part-cross-section, part schematic illustration of one embodiment of the invention.

DETAILED DESCRIPTION OF THE INVENTION

It is desirable to ensure good, and controlled, flow of exhaust gas through the reformer catalyst. Whilst there is a slight positive pressure in the engine out exhaust, it is presently believed that it is advantageous to assist flow by utilising the vacuum in the inlet manifold to assist flow. Of course, other possibilities such as some form of pumping, may be advantageous for specific engine designs.

The composition of the catalyst is not critical to the present invention, and may be any suitable steam reforming catalyst. It may be, for example Pt and/or Pd on ceria. The catalyst is desirably carried on a flow-through metal honeycomb support. Although such a metal support is highly robust, it is also conductive and permits the easy transport of heat from the hot gases outside and inside the annulus. Desirably the annular catalyst is only a small number of cells in thickness, for example 5 or 6 cells in thickness.

Conveniently the annular housing has one open end to permit entry of hot exhaust gases, and a closed end in which the reformate is collected before leaving by the outlet. Desirably, the closed end of such a housing has one or more exhaust exit holes to provide easy flow of gases through the centre of the annulus. It is recognised that an annular reformer catalyst is disclosed in SAE-07NAPLES-175, but that arrangement does not recommend that exhaust gases flow freely through the centre of the annulus but states that higher performance is realised with a three-way exhaust catalyst (TWC) being mounted within the annulus. The heat from the exotherm within the TWC heats the annular catalyst by conduction. Thus, the SAE paper co-locates the annular catalyst with the TWC, which would be an under-floor position on a vehicle such as a private car. All-in-all, the SAE paper teaches a different structure of reformer from that of the present invention.

Gasoline from the engine's fuel line is fed, desirably under control of the electronic engine management unit, to the reformer. A conventional fuel injector may be used, and the fuel is vaporised, for example by contact with a ribbed annulus which is heated by the exhaust gases.

The exhaust manifold includes one or more exhaust ports connected to a conventional exhaust pipe, which may lead to a TWC and/or other exhaust gas aftertreatment.

The reformate is led out of the reformer for feeding back to the inlet side of the engine, conveniently by feeding into the EGR line. If the reformate is fed into the EGR line upstream of the EGR valve, and depending upon the respective flow rates and volumes of reformate and recirculated exhaust, it may be desirable to cool the reformate before mixing with recirculated exhaust. Such cooling may be achieved by a heat exchanger utilising engine coolant, or possibly by forced air cooling.

A six-cylinder in-line gasoline engine is indicated at 1, and comprises the engine block 1*a*, the cylinder head 1*b* and the cam cover 1*c*. Mounted on the side of the cylinder head is a modified exhaust manifold 2. The manifold is connected by an exhaust pipe 3 to a three-way catalyst 4.

Within the manifold is mounted an annular housing 5 containing a thin annular reforming catalyst carried on a metal honeycomb support (not separately shown). The housing 5 includes an open end 5*a* and a closed end 5*b*. At the open end, a fuel injector 6 is capable of injecting fuel onto the surface of a ribbed annulus 8, connecting with the catalyst. The ribbed annulus is heated by passage of exhaust gas, and provides an extended surface on which the gasoline is vaporised. The fuel injector is cooled using circulating coolant from the engine. The fuel injector may provide a constant flow of fuel, but preferably is under the control of the engine management system (not shown).

The annular housing has one or more exit ports 9, which permits exhaust gas entering the annular housing through end 5*a*, to exit and to mix with the remainder of the exhaust gases before entering the exhaust pipe 3. Flow of the engine-out hot exhaust gases are indicated by arrows.

The fuel/exhaust gas mixture is converted to reformate whilst flowing within the catalyst. Reformate, including any unreacted fuel and exhaust gas components, is collected in a manifold 10 and fed through a reformate line 11 through an optional reformate cooler 12. The reformate cooler is cooled by circulating engine coolant through a coolant line 13. The resulting cooled reformate is then taken through the reformate line to be fed into recirculated exhaust gas upstream of the EGR valve (not shown).

A reformer system according to the present invention and in accordance to the above specific description has been constructed and has been fitted in a modified exhaust manifold attached to a straight six Holden gasoline engine.

The skilled engineer can adapt the present invention in a number of ways and to apply to a number of different engine designs.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. An exhaust gas treating system for a gasoline engine, comprising an exhaust gas manifold comprising an annular reforming catalyst mounted within an annular housing and fuel supply means in direct fluid connection with the catalyst, an outlet for reformed fuel products in direct fluid connection with the catalyst, and means to permit a proportion of the engine-out exhaust gases to enter the annular catalyst to mix with fuel from the fuel supply means and to pass through the catalyst, the annular housing being located such that hot engine-out exhaust gases flows around and through the centre of the housing, such that heat is transferred from the exhaust gases to the catalyst within the housing, wherein the annular reforming catalyst is located within the exhaust gas manifold.

2. A system according to claim 1, wherein the annular reforming catalyst is carried on a metal flow-through catalyst support.

3. A system according to claim 1, further comprising means to supply reformed fuel products from the outlet to an inlet manifold of the engine.

4. A system according to claim 1, further comprising means to utilise net manifold vacuum to assist the flow of exhaust gas and fuel through the reformer catalyst.

5. A system according to claim 1, wherein the fuel supply means is a fuel injector controlled by an electronic engine management unit of the engine.

6. A method of increasing the efficiency of a gasoline engine, comprising treating exhaust gas from the engine with an exhaust gas treating system comprising an exhaust gas manifold comprising an annular reforming catalyst mounted within an annular housing and fuel supply means in direct fluid connection with the catalyst, an outlet for reformed fuel products in direct fluid connection with the catalyst, and means to permit a proportion of the engine-out exhaust gases to enter the annular catalyst to mix with fuel from the fuel supply means and to pass through the catalyst, the annular housing being located such that hot engine-out exhaust gases can flow around and through the centre of the housing, such that heat is transferred from the exhaust gases to the catalyst within the housing, wherein the annular reforming catalyst is located within the exhaust gas manifold.

7. A method according to claim 6, wherein the annular reforming catalyst is carried on a metal flow-through catalyst support.

8. A method according to claim 6, further comprising means to supply reformed fuel products from the outlet to an inlet manifold of the engine.

9. A method according to claim 6, further comprising means to utilise inlet manifold vacuum to assist the flow of exhaust gas and fuel through the reformer catalyst.

10. A method according to claim 6, wherein the fuel supply means is a fuel injector controlled by an electronic engine management unit of the engine.

* * * * *